United States Patent [19]

Chestnutt

[11] Patent Number: 5,070,828

[45] Date of Patent: Dec. 10, 1991

[54] MOWER STARTER

[76] Inventor: Billy D. Chestnutt, Rte. #1, Box 299, Magnolia, N.C. 28453

[21] Appl. No.: 571,011

[22] Filed: Aug. 24, 1990

[51] Int. Cl.[5] ..... F02N 3/04

[52] U.S. Cl. ..... 123/185.4; 56/10.5

[58] Field of Search ..... 123/185 BB, 179 SE, 123/185 C; 56/10.5

[56] References Cited

U.S. PATENT DOCUMENTS

| | | | |
|---|---|---|---|
| 2,850,003 | 9/1958 | Konle | 123/185 BB |
| 3,018,768 | 1/1962 | Thompson | 123/185 BB |
| 3,381,677 | 5/1968 | Hunter | 123/185 BB |
| 4,397,274 | 8/1983 | Tarnedde | 123/185 BB |

FOREIGN PATENT DOCUMENTS

| | | | |
|---|---|---|---|
| 2623517 | 3/1978 | Fed. Rep. of Germany SE | 123/179 |
| 60-224957 | 11/1985 | Japan | 123/185 BB |

*Primary Examiner*—Andrew M. Dolinar

*Attorney, Agent, or Firm*—John B. Dickman III

[57] ABSTRACT

A power operated lawn mower with an internal combustion engine having a pull cord starter mechanism and a foot operated attachment for pulling the starter cord. The foot operated starter pull cord attachment mounts on the rear of a cutting blade housing and has a vertical support and a V-shaped lever pivotal on the vertical support. One arm of the V-shaped lever connects to the starter pull cord and the other arm has a foot pedal for applying an accelerating force to the cord. The vertical support raises the height of the pivotal lever to a position where the movement of the lever arms provides a maximum pulling force in a short distance.

2 Claims, 1 Drawing Sheet

MOWER STARTER

BACKGROUND OF THE INVENTION

The invention is directed to a foot operated starter for power lawn mowers with pull cord starter. There are several U.S. patents directed to foot operated starters; the following list of patents includes all the patents which the inventor is aware of on foot operated attachments for pulling a starter pull cord:

U.S. Pat. No. 2,850,003 Konle
U.S. Pat. No. 3,018,768 Thompson
U.S. Pat. No. 3,381,677 Hunter
U.S. Pat. No. 4,397,274 Tarnedde A review of the listed patents will show that while parts of the foot operated starter attachments are similar, they do not show the mechanical parts or mechanical advantage of the present invention. The patent issued to Konle, U.S. Pat. No. 2,850,003, provides a foot operated starter device which is Y-shaped and pivoted at its lowest point on the cutter blade housing. The height of the Y-shaped design and its low pivot point of the foot operated starter device makes a very large arc when pivoted. The direction of movement is first toward the operator down and back toward the mower. Therefore, the first part of the movement provides little, if any, acceleration to the starter pull cord. Further, the first movement can actually pull the lawn mower toward the operator unless an opposite force is applied. The possible movement can cause a hazard to the operator that can be avoided by the present invention.

Thompson, U.S. Pat. No. 3,018,768, discloses a foot operated starter device having a shallow V-shaped lever mounted on a short vertical support on a cutter blade housing. Due to the shallowness of the V-shaped lever, the length of the travel of the pivoted lever is relatively small. To overcome the short pivotal movement, a pulley is mounted on one end of the lever arm and the free end of the starter pull rope is tethered to the cutter blade housing, thereby increasing the length of travel of the cord, twice the length of travel of the V-shaped lever.

In Hunter, U.S. Pat. No. 3,381,677, a foot operated starter device is mounted by a bracket to the engine cover or shroud. A pivoted, U-shaped lever is pivoted to the bracket with a starter pull cord connector on the U-shaped lever. When pressure is applied to a foot pedal, the lever pivots down pulling the pull cord over a pulley on the bracket to rotate the starter. The location of the U-shaped lever, in front of the mower handle, makes it awkward to push down on the pedal without interference from the handle. Further, the only support for the starter device is the special design of the engine cover. Another engine cover without the rearwardly projection could not support the bracket adequately, and would therefore, create stresses on the cover.

The foot operated starter device in Tarnedde, U.S. Pat. No. 4,397,274, consists of a V-shaped lever comprised of a pedal arm and a plurality of leaf springs forming a pull cord arm. The leaf springs give added impulse or acceleration to the starter. The V-shaped lever is pivotally mounted on the cutter blade housing. Another embodiment shows a V-shaped lever with a pulley arrangement for doubling the length of travel of the pull cord, which increases the pulling force and acceleration of the pull cord.

Each of the above patents represents a solution for foot operated starters on lawn mowers. All of the starters are pivotal and intended to increase the acceleration of the pull cord and starter. But, in order to achieve the desired results, the cost of manufacturing is quite high. For example, the Konle starter device is made of tubing and has a plurality of bends; the bracket in Hunter requires special equipment to form the bends, and Tarnedde uses expensive leaf springs. In addition, Thompson and Hunter require pulleys and adaptions to function. The present invention is inexpensive to manufacture and is adaptable to all types of lawnmowers with pull cord starters.

The foot operated starter of the present invention provides more than sufficient pull on the starter cord to accelerate the starter mechanism. And the foot operated starter is operated without the hazard of pulling the mower toward the operator.

It is therefore the object of the foot operated starter device to provide an inexpensive device that is adaptable to all types of mowers, and at the same time will accelerate the starter mechanism without any hazard during the foot operation. These and other objects will be apparent from the drawing, written description and claims.

DESCRIPTION OF THE INVENTION

Figure 1:
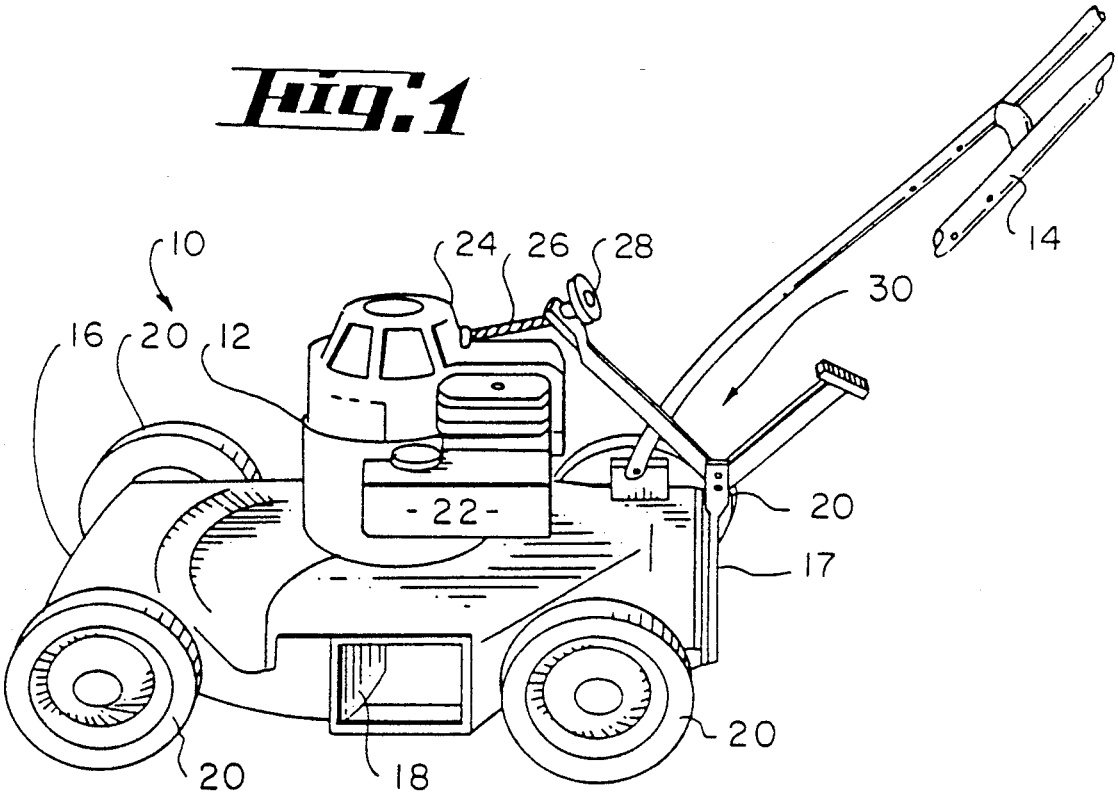
FIG. 1 is an isometric view of a foot operated starter device of the invention.

Referring to the drawings, there is shown a gasoline powered lawn mower 10 with an internal combustion engine 12 and a handle 14. The lawn mower 10 has a cutter blade housing 16 on which the engine 12 and handle 14 are mounted. The housing 16 has a grass exit shoot 18 and wheels 20.

The internal combustion engine 12 has an output shaft connected to a cutter blade (not shown), a gasoline tank 22 and a starter mechanism 24. To start the engine 12 the counter-weighted starter mechanism 24 is rotated at high speed at such a rate to cause initial combustion of the fuel. The starter mechanism is rotated by a pull cord 26 either with a handle 28 connected to a foot operated starter device 30. Acceleration of the starter mechanism 24 is only achieved by a long hard pull on the pull cord 26. This accelerated pull is accomplished with the foot operated starter device 30 that can be adapted to most all types of pull starter power lawn mowers.

Figure 2:
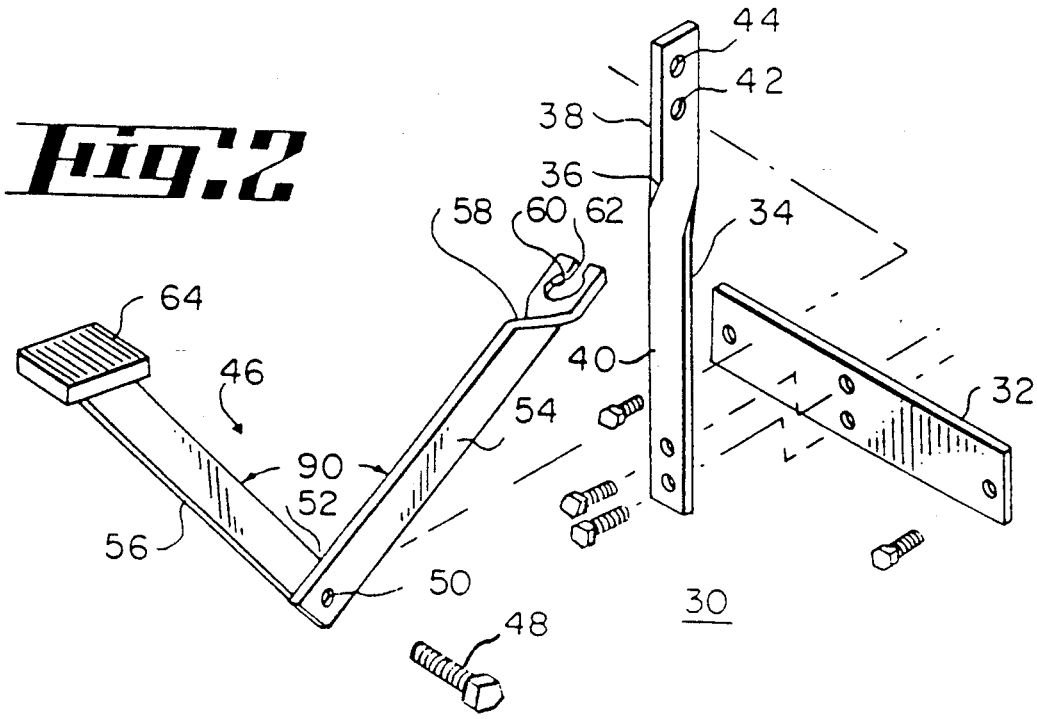
FIG. 2 is another isometric view of the foot operated starter device of the invention showing the device disassembled.

Foot operated starter device 30 is mounted on the rear skirt 17 of cutter blade housing 16 by a mounting plate 32 (FIG. 2) using bolts and lock washers. A vertical support 34 is bolted or welded to the mounting plate 32. The vertical support 34 is twisted at 36 so that the upper end 38 is at right angle to the lower end 40. Pivot holes 42 and 44 are provided in the upper end 38, these holes allow vertical adjustment of a V-shaped lever 46.

The V-shaped lever 46 is pivotally mounted on vertical support 34 by a bolt 48 passed through a hole 40 in the elbow 52 of the lever 46. The V-shaped lever 46 has a pair of arms 54 and 56, which are welded together at a 90 degree angle. Arm 54 is twisted at 58 to a 90 degree angle and has a keyhole type opening 60 which is an open slot 62 for receiving and holding handle 28 of the starter pull cord, as in FIG. 1. The other arm 56 has a foot pedal 64 on its free end, which when forced downwardly pivots V-shaped lever 46 and pulling pull cord 26 at an accelerated speed.

An important feature of the foot operated starter device 30 is the relationship of the V-shaped lever 46 to the pull cord 26. The V-shaped lever 46 pivots in a manner to pull the pull cord 26 slightly upward and in the direction of the starter device 30 without any wasted motion. The movement has to be accomplished at an accelerated rate, therefore, a long hard pull on the cord 26 directly away from the starter mechanism is necessary. There should be no upward or downward motion. To insure a maximum pull on the cord 26, the vertical support is mounted on the cutter blade housing 16 with the pivot holes 44 or 42 positioned where the V-shaped lever 46 will pull the pull cord 26 slightly upward and then will be aligned with the pull cord 26 to make sure there is no downward pull which will reduce the accelerated pull near the end of pivoted movement of the V-shaped lever 46.

To use the mounted foot operated starter device 30, foot pressure is applied to pedal 64, which pivot V-shaped lever 46 and pulling on pull rope 26 to rotate starter mechanism 24 at an accelerated rate. Arms 54 and 56 move approximately 90 degrees which is enough to give a long hard pull on cord 26.

It should be understood that while only one embodiment of the invention has been described, those skilled in the art may realize other embodiments, therefore, one should consider the invention from the drawing, claims and description for a full understanding.

I claim:

1. A foot operated starter device for operating a pull cord starter of an internal combustion engine of a power lawn mower which has a cutter blade housing that supports the engine comprising:

a) a vertical support on the cutter blade housing for supporting a foot operated starter device;

b) a V-shaped lever pivoted on the vertical support where the vertical support and V-shaped lever are at a height to pull the pull cord slightly upward and horizontally from the pull cord starter, there being no downward pull of the pull cord payed from the engine starter; and c) said V-shaped lever having a pair of arms at 90° from one another, one of said arms having a connector means for receiving and holding the pull cord as the cord is pulled, and the other of said arms having a pedal means for pivoting the V-shaped lever;

d) said vertical support has at least two pivot support means for final height adjustment of the foot operated starter.

2. A foot operated starter device as in claim 1 wherein a mounting plate is mounted on a rear skirt of the cutter blade housing for supporting the vertical support means.

* * * * *